US007422172B1

(12) United States Patent
Lo

(10) Patent No.: US 7,422,172 B1
(45) Date of Patent: Sep. 9, 2008

(54) PAPER SHREDDER CUTTING TOOL HAVING MULTIPLE CUTTING EDGES (-)

(76) Inventor: Emily Lo, No. 18, 20 Lane, Hsing Feng Street, Hsin Chuang City, Taipei Shien (TW)

( * ) Notice: Subject to any disclaimer, the term of this patent is extended or adjusted under 35 U.S.C. 154(b) by 93 days.

(21) Appl. No.: 11/123,393

(22) Filed: May 4, 2005

(51) Int. Cl.
*B02C 18/16* (2006.01)

(52) U.S. Cl. ..... 241/236; 241/295

(58) Field of Classification Search ..... 241/236, 241/295

See application file for complete search history.

(56) References Cited

U.S. PATENT DOCUMENTS

| | | | | |
|---|---|---|---|---|
| 3,974,970 | A * | 8/1976 | Bertrand et al. | 241/222 |
| 4,206,882 | A * | 6/1980 | Barnes et al. | 241/221 |
| 5,275,342 | A * | 1/1994 | Galanty | 241/73 |
| 6,513,740 | B2 * | 2/2003 | Ho | 241/236 |
| 6,565,026 | B1 * | 5/2003 | Hall | 241/225 |
| 2006/0049291 | A1 * | 3/2006 | Rajewski | 241/167 |

* cited by examiner

*Primary Examiner*—Mark Rosenbaum
(74) *Attorney, Agent, or Firm*—Pro-Techtor Int'l Services

(57) ABSTRACT

A paper shredder cutting tool having multiple cutting edges (-) constructed from a pair of cylindrical rotary cutters, which are each separately mounted on a polygonal shaft, and a plurality of cutting blades are securely mounted on the shafts. A paper guide is configured between each pair of adjacent cutting blades, thus partitioning the cutting blades therebetween, and thereby allowing the cutting blades to be assembled and mounted in an interleaving fashion on the two cylindrical rotary cutters. Moreover, each of the cutting blades is further constructed from a pair of blades. Having a plurality of cutting edges circumferentially arranged and minimally separated on each of the pair of blades, thereby forming a compact assembly of blade edges. The paper shredder cutting tool provides capability to feed around tens sheets of paper or cardboard at one time, thereupon being rapidly shredded into small bits. The present invention is characterized that, saw-toothed cutting blades comprising two sets of blades are constructed into a radiate fashion by configuring one set thereof counter clockwise on one half of a shaft, and the other set clockwise on the second half of the shaft. The radiate pattern of the cutting blades prevents the pieces of paper from slanting and enables the paper to be ripped into small bits completely.

1 Claim, 3 Drawing Sheets

PAPER SHREDDER CUTTING TOOL HAVING MULTIPLE CUTTING EDGES (-)

BACKGROUND OF THE INVENTION (a) Field of the Invention

The present invention relates to paper shredders, and more particularly to a split shredder bin consisted of a plurality of saw-toothed cutting blades each comprising two sets of blades, wherein one of the sets is counter clockwise configured on one half of a shaft, and the other is clockwise configured on the other half. A radiate pattern formed by the cutting blades prevents pieces of paper from slanting while feeding and offering paper shredding with optimized efficiency.

(b) Description of the Prior Art

Referring to FIGS. 2~5, which shows a conventional paper shredder cutting tool comprising an electric motor 100, which drives and thereby rotates a decelerator 200 comprising a number of gears. The decelerator 200 axially connects to shafts of two cutting tools, the two cutting tools being constructed to include two cylindrical rotary cutters 10 and 10'. Each of the rotary cutter 10 and 10' are mounted on a polygonal shaft 12, and a plurality of cutting blades 14 are securely mounted on the shafts 12. A paper guide 16 is configured between each pair of adjacent cutting blades 14, thus partitioning the cutting blades 14 therebetween, and thereby allowing the cutting blades 14 to be assembled and mounted in an interleaving fashion on the two cylindrical rotary cutters 10 and 10'. Moreover, each of the cutting blades 14 is further constructed from a pair of blades. 11 to 21 cutting edges 18 are respectively defined on the pair of blades of the cutting blades 14, thereby realizing minimum distance between mutually adjacent cutting edges 18 (as depicted in FIG. 5), and thus time paper comes into contact with the cutting edges 18 is very short, accordingly the cutting blades 14 slice the paper more quickly and with greater effectiveness. Furthermore, referring to FIG. 2, which shows the cutting blades 14 of the two cylindrical rotary cutters 10 and 10' interleavingly mounted so as to form a compact assembly of blade edges, such that when a sheet of paper is fed between the two cutting blades 14, the sheet of paper is first pulled and dragged downwards and then shredded. Multiple sheets of paper or cardboard are also easily shredded into small pieces.

SUMMARY OF THE INVENTION

Therefore, a primary objective of the present invention is to provide a saw-toothed cutting blade comprising two sets of blades mounted onto a shaft to form a paper shedder cutting tool with the cutting blades in a radiate fashion, thereby offering paper shredding with greater effectiveness.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
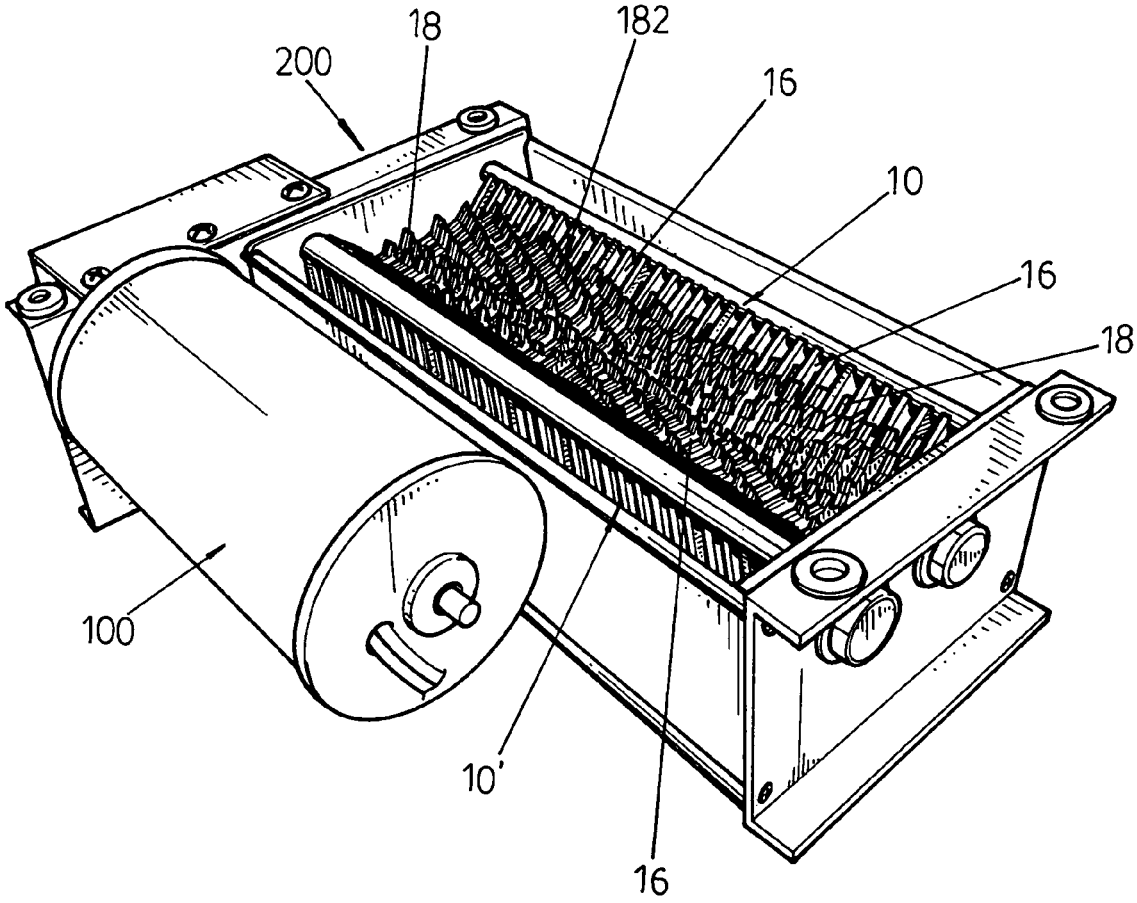
FIG. 1 shows an elevational view according to the present invention.
Figure 2:
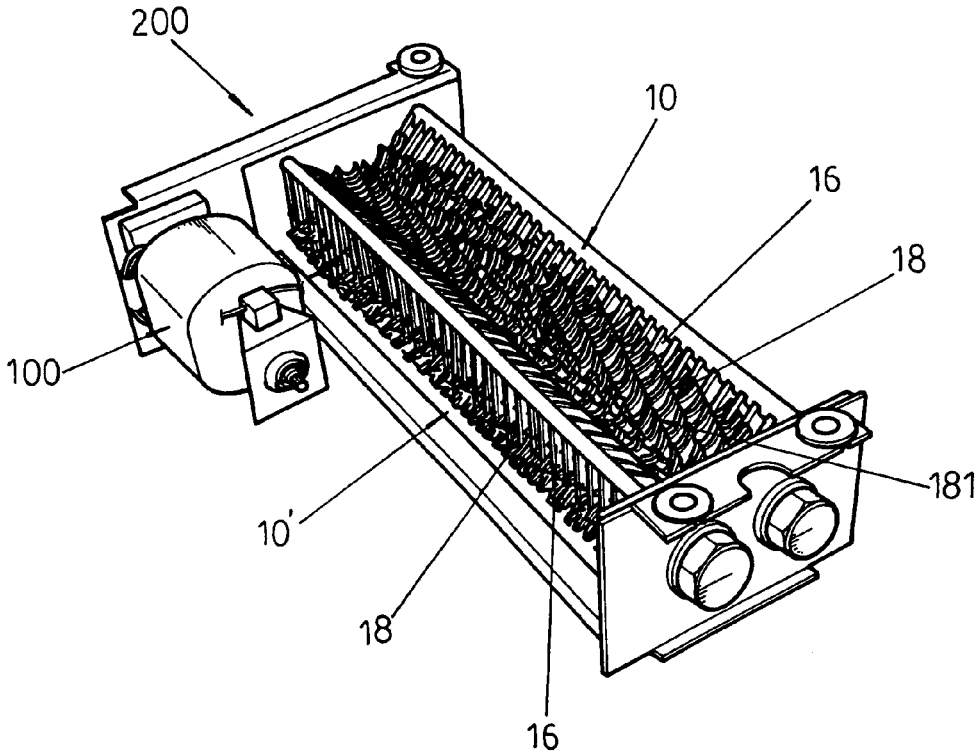
FIG.2 (PRIOR ART)
FIG. 2 shows a schematic view of a conventional paper shredder cutting tool.
Figure 3:
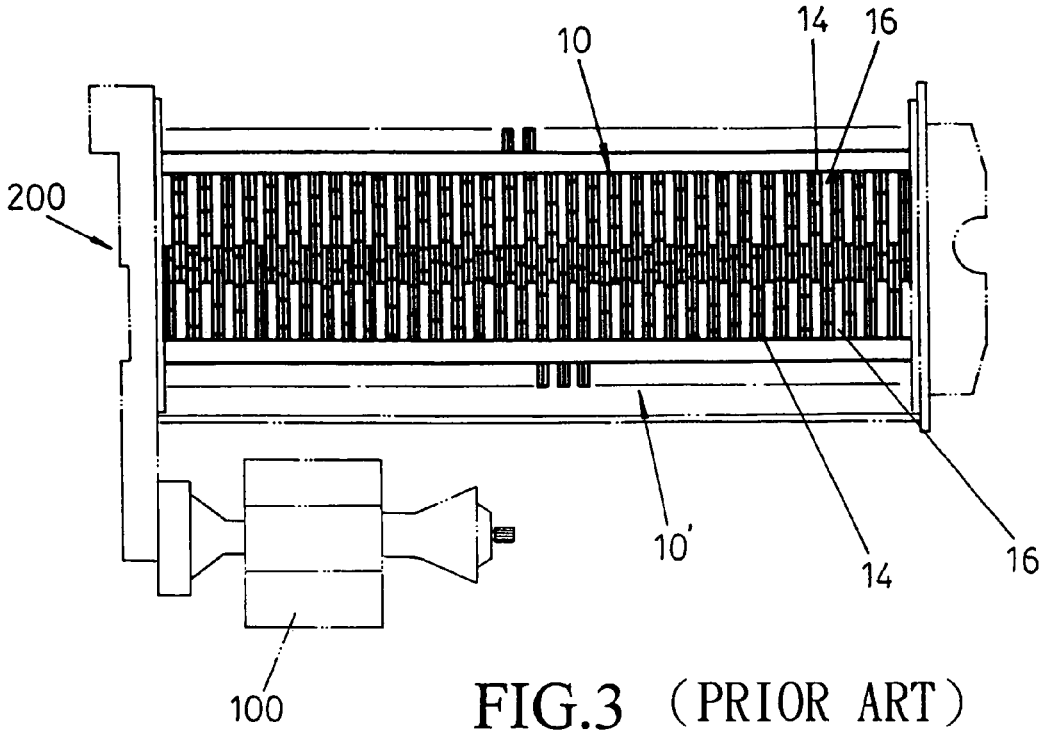
FIG.3 (PRIOR ART)
FIG. 3 shows a top view of a conventional paper shredder cutting tool.
Figure 4:
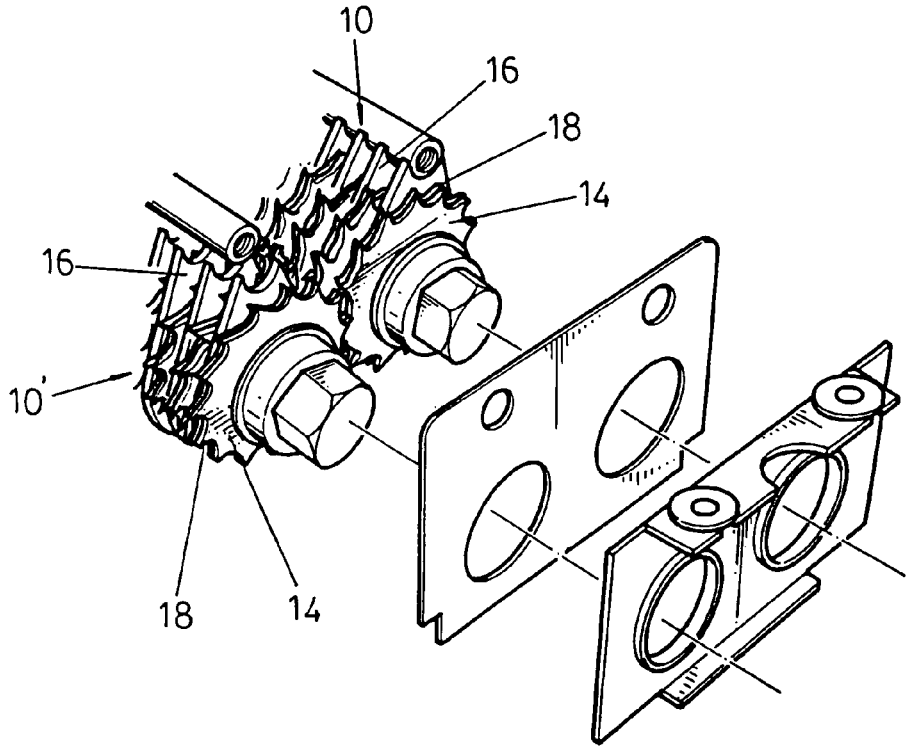
FIG.4 (PRIOR ART)
FIG. 4 shows a partial exploded elevational view of a conventional paper shredder cutting tool.
Figure 5:
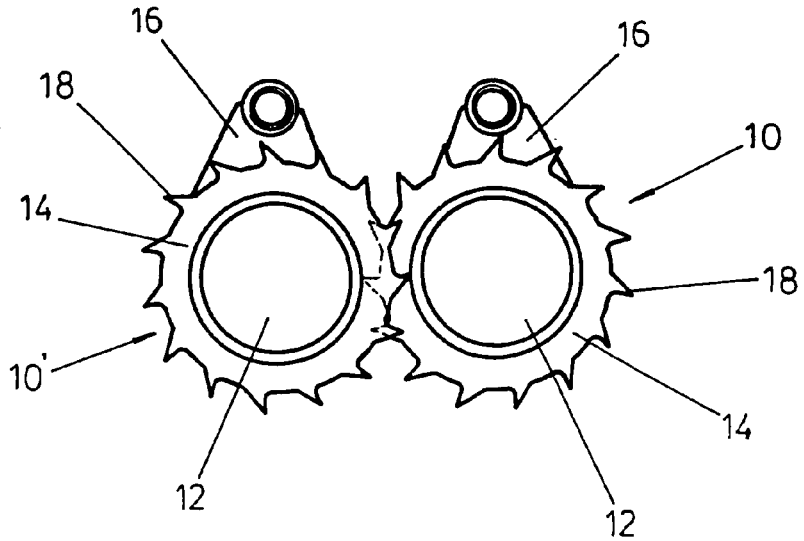
FIG.5 (PRIOR ART)
FIG. 5 shows a side view of assembled cutting blades of a conventional paper shredder cutting tool.

Referring to FIG. 1, which show a paper shredder of the present invention comprising an electric motor 100, which drives and thereby rotates a decelerator 200 comprising a number of gears. The decelerator 200 axially connects to shafts of two cutting tools, the two cutting tools being constructed to include two cylindrical rotary cutters 10 and 10'. Each of the rotary cutter 10 and 10' are mounted on a polygonal shaft 12, and a plurality of cutting blades 14 are securely mounted on the shafts 12. A paper guide 16 is configured between each pair of adjacent cutting blades 14, thus partitioning the cutting blades 14 therebetween, and thereby allowing the cutting blades 14 to be assembled and mounted in an interleaving fashion on the two cylindrical rotary cutters 10 and 10". Moreover, each of the cutting blades 14 is further constructed from a pair of blades. The present invention is primarily characterized in that: One set of the saw-toothed cutting blades 14 of the paper shredder cutting tool comprising two sets of blades is configured counter clockwise on one end (including approximately 17 sets of the cutting blades 14) of the polygonal shaft 12, on which the blades are configured clockwise on the other end of polygonal shaft 12, and thereupon the blades become a radiate pattern 182 as shown in FIG. 2, with the cutting edges 18 of each of the rotary cutters 10,10' forming a single chevron pattern centered at a middle of the cutters having the apexes of the respective chevrons leading toward each other into the intersection formed between the cutters 10, 10' (the intersection is illustrated in FIG. 5), in such a manner that interlacing distances of two cylindrical rotary cutters 10 and 10' at a center section are shorter than those at the sides thereof. The polygonal shaft 12 is rotated 30° before assembling so as to assemble the two cylindrical rotary cutters 10 and 10' in symmetrical fashion. When the pieces of paper are fed slantwise into the intersection between the two cylindrical rotary cutters 10 and 10', two sides of the paper are still shredded completely and thus ensuring effective shredding function thereby.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A paper shredder cutting tool having multiple cutting edges, comprising a first cylindrical rotary cutter and a second cylindrical rotary cutter, which are configured to rotate in opposite directions to each other, and each of the rotary cutters is mounted on a polygonal shaft having a first end and a second end, and a plurality of cutting blades are securely mounted on the shafts; a paper guide is configured between each pair of adjacent cutting blades, thus partitioning the cutting blades therebetween, and thereby allowing the cutting blades to be assembled and mounted in an interleaving fashion on the two cylindrical rotary cutters, wherein each of the cutting blades is further constructed from a pair of blades; a plurality of cutting edges are circumferentially arranged and defined on a periphery of each of the pair of blades of the cutting blades;

said cutting tool further comprising said first rotary cutter having said polygonal shaft with all of said plurality cutting blades being clockwise on a first end thereof and all of said plurality cutting blades being counterclockwise on a second end thereof, and said second rotary cutter having said plurality of cutting blades in an opposite orientation to corresponding cutting blades of said first rotary cutter;

wherein the cutting blades of said cutting tool have a radiate pattern with the cutting edges of each of the first and second rotary cutters forming a single chevron pattern centered at a middle of the cutters with the apexes of the respective chevrons leading toward each other into the intersection formed between the first and second rotary cutters.

* * * * *